United States Patent [19]

Rohr

[11] 4,102,284

[45] Jul. 25, 1978

[54] STACKER MECHANISM

[75] Inventor: Günter Rohr, Hemmingen, Fed. Rep. of Germany

[73] Assignee: Union Special G.m.b.H., Stuttgart, Fed. Rep. of Germany

[21] Appl. No.: 811,103

[22] Filed: Jun. 29, 1977

[30] Foreign Application Priority Data

Sep. 7, 1976 [DE] Fed. Rep. of Germany ..... 2640148

[51] Int. Cl.[2] ..... D05B 33/00

[52] U.S. Cl. ..... 112/121.29; 214/1 BC; 214/6 D; 214/DIG. 10; 271/84

[58] Field of Search ..... 112/121.29, 121.12, 112/121.11, 121.15; 74/531; 271/84, 85; 214/1 BC, 1 BD, 6 D, DIG. 10

[56] References Cited

U.S. PATENT DOCUMENTS

| | | | |
|---|---|---|---|
| 3,170,423 | 2/1965 | Henebry | 112/121.12 |
| 3,474,747 | 10/1969 | Noiles | 112/121.12 |
| 3,621,801 | 11/1971 | Huddleston | 112/121.29 X |
| 3,871,309 | 3/1975 | Frost | 112/121.12 |
| 4,018,104 | 4/1977 | Bland et al. | 74/531 |

FOREIGN PATENT DOCUMENTS

| | | | |
|---|---|---|---|
| 2,149,273 | 4/1973 | Fed. Rep. of Germany | 112/121.29 |

*Primary Examiner*—H. Hampton Hunter

*Attorney, Agent, or Firm*—John W. Harbst; John A. Schaerli

[57] ABSTRACT

This invention relates to a stacker mechanism for removing flexible work pieces from the working area of a machine. The stacker mechanism of the present invention includes a frame, an arm, and a support member having first and second pivotal connections. The first pivotal connection serves to rotatably secure the support member to the frame and allows the arm carried thereby to be vertically rotated. The second pivotal connection allows pivotal movement of the arm in a horizontal direction. The end of the arm opposite the second pivotal connection carries a wiper mechanism for engaging and moving the work piece. A driver is employed for pivotally moving the arm. A motion retarding assembly is provided at the second pivotal connection for applying frictional restraint to the horizontal turning movement of the arm whereby a higher coefficient of friction is maintained at the second pivotal connection relative the first pivotal connection. The difference between the coefficients of friction at the pivotal connections results in a rectangular motion being imparted to the wiper mechanism during operation of the stacker mechanism. A rotational support table is provided for maintaining intermittent support of the work piece.

11 Claims, 4 Drawing Figures

STACKER MECHANISM

BACKGROUND OF THE INVENTION

The present invention relates to a stacker mechanism, especially though not limitatively, used in combination with sewing machines for removing a work piece or the like element from the work area.

The operation of a stacker mechanism in general requires that the wiper mechanism employed therewith is first moved from a non-contacting position relative the work piece to a contacting position. Once the fabric has been engaged, it is then necessary to impart to the wiper mechanism a motion enabling removal of the work piece from the work area. Finally, it is necessry to return the wiper mechanism to its initial position where it is ready to be utilized on the following work piece.

In known arrangements of this type, such has been used in connection with industrial sewing machines or the like, the fabric work pieces are fed through the sewing machine and are then engaged by a stacker mechanism at the rearward side of the machine. On heretofore known stacker devices there is provided at the free end of the pivot arm, a pneumatic cylinder means which is operable to vertically move the wiper mechanism into and out of engagement with the fabric work piece. The horizontal reciprocal or turning movement required for removing the fabric work piece from the work area is imparted to the wiper mechanism by a second pneumatic cylinder means. The end result being that the wiper mechanism is moved in a rectangular motion. However, these stackers are of expensive construction and have heretofore required a relatively complicated control device enabling sequential operation of the series of pneumatic cylinder means in order to obtain the necessary movement required to be imparted to the wiper mechanism.

SUMMARY OF THE INVENTION

In view of the foregoing, and in accordance with the present invention, there is provided a stacker mechanism which imparts to the wiper mechanism thereof a rectangular motion while at the same time utilizing a single drive mechanism and a simple control system for removing the work pieces from the work area of the machine. The present invention includes a frame, an arm, and a support member having first and second pivotal connections. The first pivotal connection rotatably secures the support member to the frame and allows the arm to be vertically rotated with respect to the frame. The second pivotal connection rotatably secures one end of the arm to the support and allows movement of the arm in a horizontal direction. A horizontal motion retarding assembly which includes a pair of friction discs, a resilient compression means, and a laterally adjustable nut, is operatively associated with the arm at the second pivotal connection. The friction discs are disposed in facial abutment with the top and bottom sides of the arm and the resilient compression means is situated between the nut and the friction disc. The motion retarding assembly applies to the second pivotal connection a higher coefficient of friction than is inherent with the first pivotal connection. This higher coefficient of friction provides a restraining force to the horizontal turning movement of the arm. A driver is employed for forcibly moving the arm about the pivotal connections. The driver is pivotally connected to the frame at a point, relative the machine, which is above and in front of the drivers pivotal connection with the arm. The difference between the coefficient of friction applied to the second pivotal connection and the coefficient of friction inherent with the first pivotal connection results in a rectangular motion being imparted to the wiper mechanism upon cyclic movement of the arm by the force driver means. With an embodiment of this sort there is provided a stacker apparatus which uses a single drive for imparting to the wiper mechanism the necessary motion and does not require the complexity of the control system for sequentially operating a series of pneumatic cylinders.

There is further provided by the present invention, a rotatable work support which is immediately rearward the work support for the machine. The top surface of the rotatable work support is in parallel alignment with the work support of the machine and is adapted to be rotatably moved between a first position, where it is in position to support the work piece carried by the wiper mechanism and a second position, out of the path of movement of the wiper mechanism. Once the support has been removed from beneath the work piece, the latter is free to fall onto a table which is in general vertical alignment with the first position of the rotatable work support whereby the work pieces are stacked in a position removed from a working area of the machine.

In view of the above, it is an important object of the present invention to provide an improved stacker mechanism for removing flexible sheet like workpieces from the work area.

Another object of this invention is the provision of a stacker mechanism of the general type referred to which is of simple construction and does not require a complexity of control systems for operating same.

Other objects, features and advantages of the present invention will become apparent upon reading the following specification when taken in conjunction with the accompanying drawings.

DESCRIPTION OF THE PREFERRED EMBODIMENT

Figure 1:
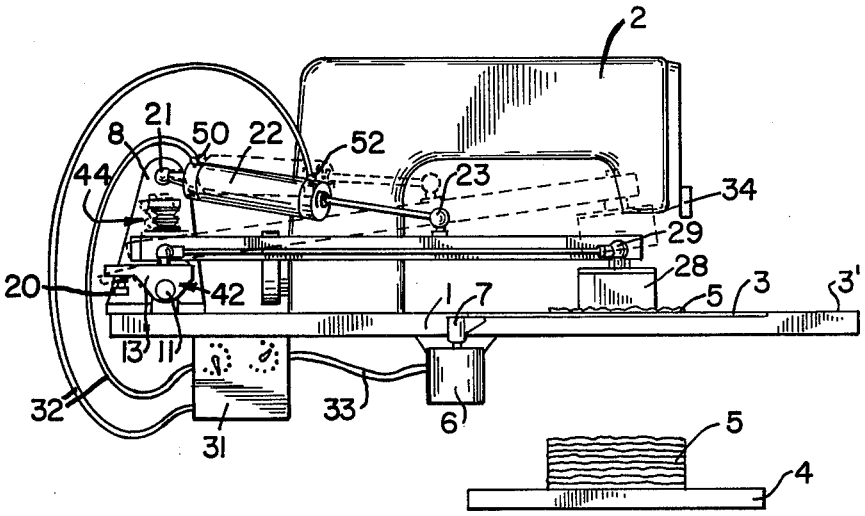
FIG. 1 is an elevation view of a stacker mechanism constructed in accordance with the principles of the invention, the illustrated position of same corresponding to the operative position of the device.

Referring now in more detail to the drawings, in which like reference numerals indicate like parts throughout the several views, and for the purpose of illustration, but without limitation, the invention will be described herein as being secured to a work support means 1 which serves to support fabric work pieces or the like which are being worked on by a sewing machine 2. However, it should be appreciated that the present invention is equally applicable to other types of machines and should not be limited to use with sewing machines. A rotatable support means 3, having a top surface means 3' which is in general parallel alignment with the top surface means of the work support means 1 is situated so that it may intermittently support the fabric work pieces 5 when the stacker mechanism is swung to its second position as shown in phantom lines in FIG. 2. The rotatable support means 3 is pivoted about an articulate connection means 7. A drive means 6 is suitably connected to the articulate connection means 7 for rotating the support means 3 from the position shown in FIG. 2 to a position where the top surface means 3' is no longer in position to support the work piece 5. Located below and in vertical alignment with the rotatable support means 3 is a table means 4 which is the final receiving point for the sewn workpieces once they are released from the stacker mechanism as will be hereinafter discussed.

Figure 3:
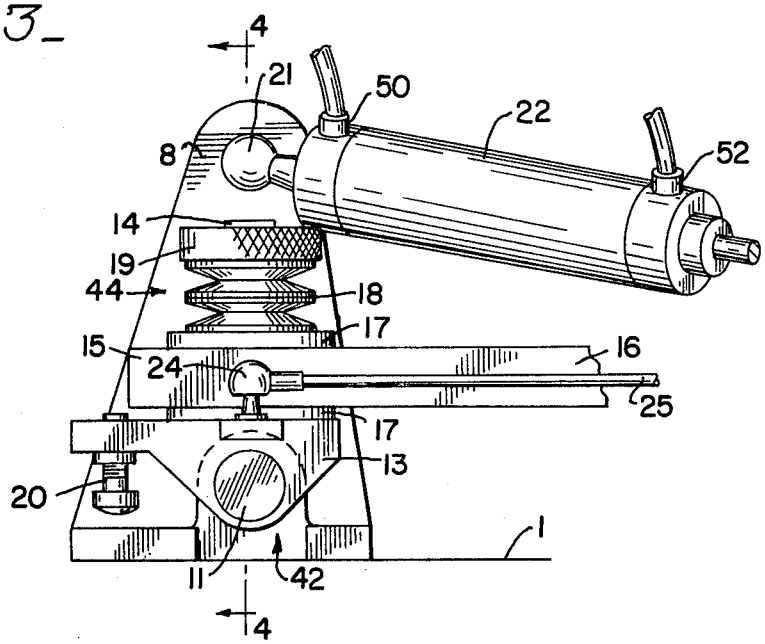
FIG. 3 is an enlarged fragmentary elevational view of one end of the stacker mechanism shown in FIG. 1.
Figure 4:
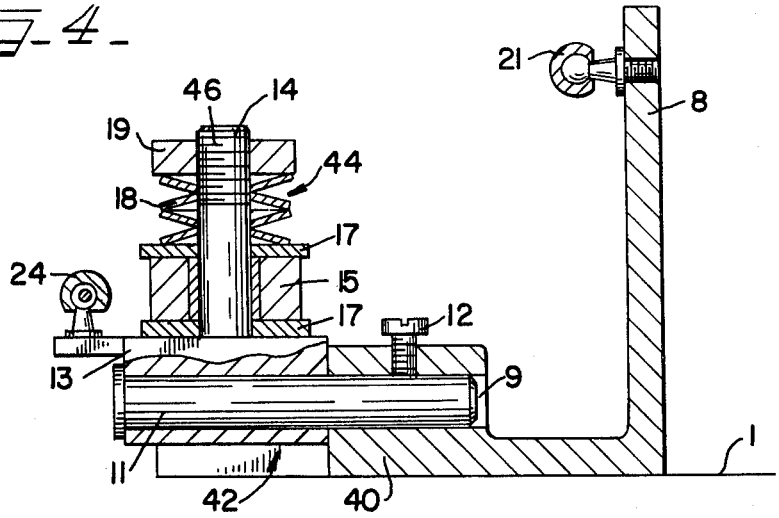
FIG. 4 is a sectional view taken along line 4—4 of FIG. 3.

As may be best seen in FIGS. 3 and 4, secured to the work support means 1 by any suitable means, is a frame means 8. The frame means 8 has secured rewardly thereof a first pivotal connection means 42. The first pivotal connection means 42 is comprised of a support means 13 which journals a horizontal pin means 11 which is secured by any suitable means, such as 12, within bore means 9 located in the rearwardly extending portion means 40 of frame means 8. The first pivotal connection means 42 allows rotational movement of the support means 13 about the longitudinal axis of the pin means 11. The degree of rotation of the support means 13 in a counterclockwise direction, viewed in FIG. 3, is limited by an adjustable limit means 20 for reasons discussed hereinafter.

Upwardly extending from the support means 13 is a second pivotal connection means 44 which is comprised of a vertical stud means 14 and the first end means 15 of a pivotal arm means 16 which journals the stud means 14. Operably associated with the first end means 15 of the arm means 16 is a horizontal motion retarding assembly means. The horizontal motion retarding assembly includes, a pair of friction disc means 17, a resilient compression means 18, and a nut means 19. The friction disc means 17 are mounted about the stud means 14 and are in facial abutment with the first end means 15 of arm means 16 which is disposed therebetween. The nut means 19 is laterally adjustable along the free end 46 of stud means 14. Disposed between the nut means 19 and the friction disc means 17 is the resilient compression means 18 which, as shown in the preferred embodiment, is in the form of a series of Bellevidier washer means. The resilient compression means 18 is arranged to press against the friction disc washer means 17 whereby creating a higher coefficient of friction at the second pivotal connection means 44 relative the first pivotal connection means 42.

Figure 2:
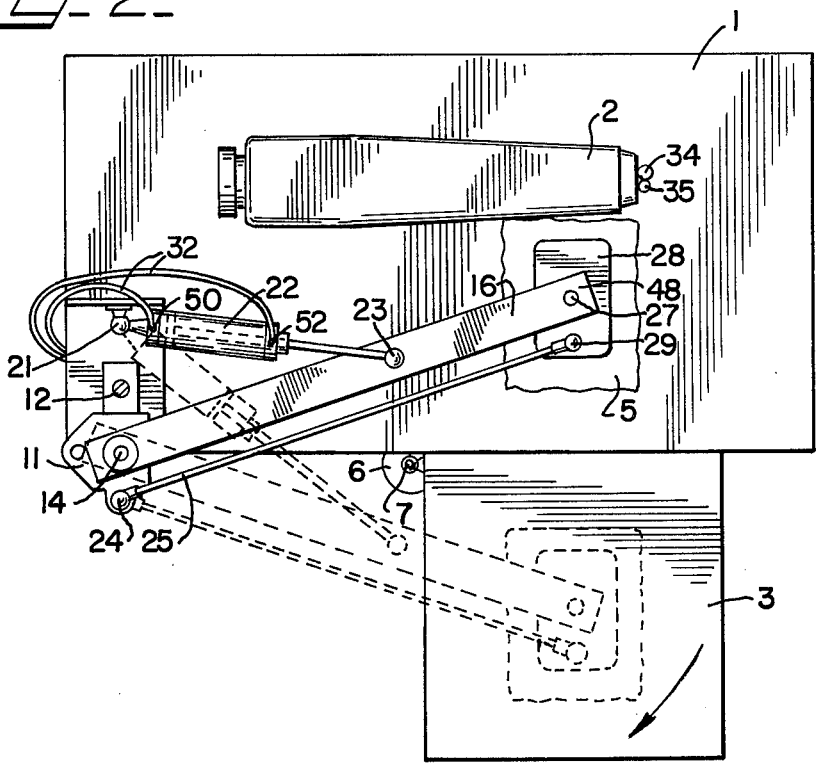
FIG. 2 is a top plan view of FIG. 1.

The stacker mechanism of the present mechanism is further provided with an actuation means or a force drive means 22 which may be in the form of a pneumatic cylinder means. The force drive means 22 is fixedly secured as at 21 to the frame means 8 by any suitable method, the one shown in the preferred embodiment being a ball and socket joint means. As shown in FIGS. 1 and 2 the other end 23 of the forcible drive means 22 is connected to the pivotal arm means 16 in a similar manner. It should be pointed out, that the force drive means pivotal connection 21 is connected to the frame 8 at a point which, relative the machine means 2, is above and in front of the pivotal connection 23 on the force drive means 22.

A conventional wiper mechanism means 28 is rotatably secured at the second end means 48 of the pivotal arm means 16 by pin means 27. Extending parallel to the arm means 16 is a link means 25 which is pivotally connected to the support means 11 as at 24 and is pivotally connected to the wiper mechanism means as is generally shown at 29. The distance between the pivotal connections 24 and 29 is equal to the distance between the stud means 14 and the pivotal connection 27 whereby forming a parallel bar linkage means. This parallel linkage means arrangement allows movement of the wiper mechanism means 28 in a parallel path whereby no disorientation of the work piece as it leaves the work area occurs.

As may be best seen in FIG. 1, a control means 31 is located on the undersurface of the work support means 1 and is connected to a source of fluid under pressure (not illustrated). Conduit means 32 lead from the control means 1 and are connected to the first and second means 50 and 52 of the force drive means 22. A further conduit means 33 connects the control means 31 with the drive means 6 for supplying the necessary force for pivotally moving the rotatable support means 3 about the articulate connection 7. The operation of the control box means 31 is controlled by a photosensor means which includes a light source means 34 and a cooperative photo cell means 35 both of which are in close proximity of the working area of the machine for sensing the presence, or lack thereof, of a material work piece 5.

OPERATION OF THE MECHANISM

Upon exposure to a light beam from the light source means 34, which happens when the work piece has been passed through the work area of the machine, the photo cell means 35 is rendered effective to produce a signal which is transmitted to the control means 31. The signal to the control means 31 serves to deliver fluid under pressure to the first end means 50 of the force drive means 22. It should be appreciated that the position of the stacker mechanism during sewing is shown in phantom lines in FIG. 1 and solid lines in FIG. 2. The deliverance of fluid under pressure to the first end means 50 of the force drive means 22 enables activation of the latter whereby forcibly moving the arm means 16 in a downward pivotal motion about the first pivotal connection means 42. Keeping in mind that there is resistance to horizontal turning movement of the arm means 16 supplied by the horizontal motion retarding assembly it is apparent that initial movement of the arm means 16 is constrained to move in a vertical plane since the coefficient of friction at the first pivotal connection means 42 is less than the coefficient of friction at the second pivotal connection means 44. The downward pivotal motion of the arm means 16 toward the work surface continues until such time as the wiper mechanism means 28 has made contact with the work piece means 5 and the work support means as shown in solid lines in FIG. 1. The work support means 3 prevents further downward pivotal motion of the arm means 16. Once the arm means 16 has been arrested from further vertical movement, the continual actuation of the force drive means 22 delivers to the arm means 16 a force having a horizontal component which is greater in magnitude than the resistance to turning movement force placed upon the arm means 16 by the motion retarding assembly means whereby rotation of the arm means 16, about the second pivotal connection means 42, in a horizontal plane occurs. The horizontal movement of the arm means 16 and the wiper mechanism means 28 carried thereby removes the work piece 5 from the working area and moves the work piece and the arm means into the phantom line position shown in FIG. 2. It should be appreciated that the work piece shown in phantom lines in FIG. 2 is now supported by the rotatable support means 3.

With reference to the rotatable support means 3, it should be noted that the control means 31 is adjusted so as to maintain the rotatable support means 3 in the position shown in FIG. 2 for a predetermined length of time after receiving the initial signal from the photo sensor means 35. Upon expiration of this predetermined extent of time, the control means supplies fluid under pressure, or as may be equally applicable, an electrical signal, to the drive means 6 which in turn forcibly rotates the table means 3 about its articulate connection means 7. The engagement between the wiper mechanism means 28 and the work piece means 5 prevents the latter from being carried along with the rotatable support means during movement of same. Once the rotatable support means 3 and more particularly the top surface means 3' has been removed from supporting the work piece means 5 the latter is free to fall onto the table means 4 where it is stacked in an area removed from the work area. Once the fabric work piece has been stacked on the table means 4, the control means 31 simultaneously returns the rotatable support means 3 and the pivotal arm means 16 to their initial positions. That is, the fluid under pressure is removed from the first end means 50 of the actuator 22 and transferred to the second end means 52 thereof whereby forcibly retracting the actuator to its initial position. Upon retraction of the force drive means 22 the pivotal arm means is again initially swung in a vertical direction away from the work support 1 about the first pivotal connection 42 due to the higher coefficient of friction inherent at the second pivotal connection 44 relative the coefficient of friction at the first pivotal connection 42. The vertical rotation of the arm means continues until such time as the limit means 20 arrests the pivotal motion of the support member 20 and the arm means 16 carried thereby in the counterclockwise direction as viewed in FIG. 3. The continued retracting force delivered to the pivotal arm means by the force drive means 22 can no longer exert a vertical force on the arm means in view of the limitations imposed thereon by the limit means 20. Therefore, the horizontal force component of the retracting force overcomes the magnitude of resistance to turning movement of the arm exerted on the second pivotal connection by the horizontal motion retarding assembly means whereby turning the pivotal arm means in a horizontal plane and returning same to its initial position as shown in phantom lines in FIG. 1.

By comparing the preferred embodiment shown in the present invention with that which is shown in the prior art, it is evident that there has been shown a simplified form of a stacker wherein utilizing a single force drive means 22 rather than a plurality thereof such has been shown in the prior art while at the same time imparting to the wiper mechanism the required motions for removing a fabric work piece or the like from the working area of a machine. Along with that, it should be appreciated that a simple control mechanism is provided whereby enabling actuation of a single force drive member and wherein mechanical workings have been utilized to impart a rectangular motion to the wiper mechanism rather than having to operate a complex control mechanism for sequentially actuating a series of pneumatic drives. In view of the above, it is felt that there is provided a stacker mechanism which removes from the work area of the machine a work piece and deposits the same in an area removed therefrom whereby quick access may be made thereto in a safe and efficient manner.

Thus it is apparent that there has been provided, in accordance with the invention, a stacker mechanism that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed:

1. A stacker mechanism having an arm means and a wiper mechanism secured to said arm means, said stacker mechanism comprising:

a frame means;

a support means having first and second pivotal connections, said first pivotal connection adapted to rotatably mount said support means on said frame means, the second pivotal connection being adapted to pivotally mount one end of said arm means;

a single actuator means for moving said arm means about said pivotal connections; and a motion retarding assembly means operatively associated with said arm means for imparting thereto a frictional resistance to turning movement thereby creating a higher coefficient of friction at said second pivotal connection relative said first pivotal connection whereby movement of said arm means will result in said wiper mechanism being moved in the direction of least resistance.

2. The stacker mechanism of claim 1 wherein said first pivotal connection allows rotational movement of said support means in a vertical direction and said second pivotal connection allows rotational movement of said arm means in a horizontal direction.

3. The stacker mechanism of claim 1 wherein said first pivotal connection is comprised of a horizontal pin means journalled by said support means while said second pivotal connection includes a vertically extending stud means fixedly carried by said support and journalled by one end of said arm means.

4. In combination with a machine having a work area, a surface for supporting a work piece of substantially flat material, and a stacker mechanism having an arm means and a wiper mechanism secured at one end to said arm means, said stacker mechanism comprising:

a frame means;

a support means carried by said frame means, said support means having first and second pivotal connections;

said arm means being secured at its other end to said support means, the first pivotal connection on said support means being adapted to allow a predetermined degree of pivotal displacement of said arm means toward and away from said work supporting surface means, the second pivotal connection being adapted to allow pivotal displacement of said arm means toward and away from the work area of the machine;

a single drive means for effecting movement of said arm means in each of the displacement directions; and a motion retarding assembly means for imparting to said arm means a resistance to turning movement whereby said arm means is free to move toward and away from said work supporting surface means but is arrested against movement toward or away from the work area until such time as the respective limit of pivotal displacement of said arm means toward or away from said work supporting surface means has been reached.

5. In combination with a machine having a work area, means for advancing sheet like means through said work area, and a stacker apparatus adapted to remove said sheet like means from said work area, said stacker apparatus including arm means and a wiper mechanism secured to one end of said arm means, wherein the improvement comprises:

a frame means;

a support means having first and second pivotal connections, the first pivotal connection adapted to allow rotational movement of said support means relative said frame means, the second pivotal connection being adapted to rotatably secure the other end of said arm means so as to allow movement of said arm means in a direction generally perpendicular to the movement of said support means;

a single drive means pivotally connected to said frame means and said arm means for moving said arm means in said directions, the pivot point on said frame means being above the pivot point on said arm means and is disposed closer the machine relative the pivot point on said arm means; and means for imparting to said second pivotal connection a frictional resistance to turning movement thereby creating a higher coefficient of friction relative said first pivotal connection whereby causing said wiper mechanism to move in a rectangular motion.

6. The combination of claim 1 wherein said support means includes adjustable limit means limiting the degree of vertical displacement of said support means.

7. In combination with a machine having a work surface means adapted to support a work piece thereon, means for advancing said work piece through said machine, and a stacker apparatus adapted to remove said work piece from the area of said machine, said stacker apparatus including an arm means, a wiper mechanism pivotally secured at one end to said arm means, wherein the improvement comprises:

a frame means secured to said work surface means;

a support means pivotally mounted on said frame;

a stud carried on said support means for pivotally mounting the other end of said arm means for movement in a horizontal direction;

a single drive means operable to move the support means and said arm means about their respective mounting means, said drive means being coupled to said arm means and said frame means at a point on said frame means which is above and in front of said coupling point on said arm means relative the direction of movement of said workpiece;

means mounted about said stud means for imparting to the arm means a frictional resistance to turning movement thereby creating a higher coefficient of friction at said rotatable mounting for the arm means relative the rotatable mounting for the support means whereby causing said wiper mechanism to first move in a vertical direction and then move in a horizontal direction.

8. The combination of claim 7 further including a link means pivotally secured to said support means and said wiper means, the distance between the pivotal connections on said link means being equal to the distance between the corresponding pivotal connections on said arm means whereby forming a parallel bar linkage means.

9. In combination with a sewing machine having a work support means for supporting a work piece, a stacker means adapted to remove said work piece from the area of sewing to an area remote from said machine, said stacker means including an arm means, a wiper mechanism mounted on one end of said arm means, wherein the improvement comprises:

a frame means secured to said work support means;

a support means carried by said frame means for rotational movement about a horizontal axis, said support means including a vertical stud means carried thereby;

a nut adjustably threaded on said stud means;

a pair of friction disc means mounted on said stud means;

said arm means having the other end pivotally mounted on said stud means and is disposed between said friction disc means;

a single pneumatic means connected to said frame means and said arm means for moving the latter in a plurality of directions, said pneumatic means being connected to said frame means at a point which is above and in front of the longitudinal axis of said arm means; and resilient compression means disposed between said nut means and said friction disc means for frictionally applying restraint to the turning movement of said arm means whereby causing a greater coefficient of friction at the pivot point about said stud means relative the pivot point of said support means.

10. The combination of claim 9 further including a rotatable support means having a top surface means in general parallel alignment with said work support means, said rotatable support means being adapted to move from a first position where it is in position to support a work piece carried by said wiper mechanism to a second position out of the path of movement of said wiper mechanism.

11. The combination of claim 10 further including means spaced below and in general vertical alignment with the first position of said rotatable support means receiving and stacking said work pieces upon release from said stacker mechanism.

* * * * *